US005795026A

United States Patent [19]

Dral et al.

[11] Patent Number: 5,795,026

[45] Date of Patent: Aug. 18, 1998

[54] HEIGHT ADJUSTABLE CHAIR ARM

[75] Inventors: Joel Dral, Holland; Larry Wilkerson, Comstock Park, both of Mich.

[73] Assignee: Haworth, Inc., Holland, Mich.

[21] Appl. No.: 870,127

[22] Filed: Jun. 6, 1997

[51] Int. Cl.[6] ..... A47C 7/54

[52] U.S. Cl. ..... 297/411.36; 297/411.2

[58] Field of Search ..... 297/411.2, 411.35, 297/411.36, 440.24, 411.26; 248/118, 118.3

[56] References Cited

U.S. PATENT DOCUMENTS

| | | | |
|---|---|---|---|
| 50,042 | 9/1865 | Sherlock . | |
| 415,307 | 11/1889 | Carrick . | |
| 441,964 | 12/1890 | Neppert . | |
| 493,111 | 3/1893 | Parsons . | |
| 2,584,732 | 2/1952 | Okun . | |
| 4,239,282 | 12/1980 | White . | |
| 4,244,623 | 1/1981 | Hall et al. | 297/411.36 |
| 4,951,995 | 8/1990 | Teppo et al. . | |
| 5,265,938 | 11/1993 | Melhuish et al. . | |
| 5,318,347 | 6/1994 | Tseng . | |
| 5,324,096 | 6/1994 | Schultz . | |
| 5,326,154 | 7/1994 | Williamson et al. . | |
| 5,368,365 | 11/1994 | Feldberg . | |
| 5,382,079 | 1/1995 | Wilson et al. . | |
| 5,388,892 | 2/1995 | Tornero . | |
| 5,393,124 | 2/1995 | Neil . | |
| 5,393,125 | 2/1995 | Watson et al. . | |
| 5,439,267 | 8/1995 | Peterson et al. . | |
| 5,636,899 | 6/1997 | Schiff et al. | 297/441.36 |
| 5,664,842 | 9/1997 | Tseng | 297/411.36 |
| 5,667,277 | 9/1997 | Van De Riet | 297/411.36 |

FOREIGN PATENT DOCUMENTS

| | | | |
|---|---|---|---|
| 4317610 | 12/1994 | Germany | 297/411.36 |

*Primary Examiner*—Milton Nelson, Jr.

*Attorney, Agent, or Firm*—Flynn, Thiel, Boutell & Tanis, P.C.

[57] ABSTRACT

An office-type chair includes a seat assembly and back assembly which are pivotally supported on a chair base to support a user thereon. The chair also includes height-adjustable chair arm assemblies which are located on opposite sides of the seat assembly and include a height-adjustment mechanism which is readily adaptable to a variety of shapes and sizes for the chair arm assemblies. The height-adjustment mechanism is connected to an actuator mechanism which has a plurality of levers connected in series to disengage the locking mechanism.

20 Claims, 4 Drawing Sheets

HEIGHT ADJUSTABLE CHAIR ARM

FIELD OF THE INVENTION

The invention relates to an office chair having height-adjustable arms, and more particularly to an improved actuator assembly for a height-adjustable chair arm assembly which includes a plurality of serially-connected levers.

BACKGROUND OF THE INVENTION

Typical office chairs include seat and back assemblies which support the respective seat and back of a user. Additionally, many office chairs also include arm rests on opposite sides of the seat which are provided to support the user's arms.

Many different configurations are known for the arm rests. For example, many chairs employ fixed arm rests which are rigidly connected to the seat and/or back of the chair to provide an arm support surface. To increase the comfort of a user, such arm rests also can have an adjustable construction so that the position of the arm rest can be adjusted to accommodate the particular characteristics of a user. For example, it is known to provide arm rests which are height-adjustable and/or pivotable outwardly and inwardly.

The height-adjustable type of arm rests typically include a height-adjustment mechanism which is releasable to permit vertical movement of the arm rest, while also being engagable so as to fix the arm rest at a selected height. The height-adjustment mechanism typically is connected to an actuator button which is accessible from the exterior of the arm rest so as to release and reengage the height-adjustment mechanism during use. The actuator button and the structure connecting the button to the height-adjustment mechanism typically are housed within a hollow housing of the arm rest, although this space is limited and thus places constraints on the size of the button as well as the height-adjustment mechanism.

In view of the foregoing, it is an object of the invention to provide a height-adjustable chair arm which includes an improved actuator mechanism for the height-adjustment mechanism which can be readily adapted to accommodate the constraints placed thereon by the size and shape of the arm rest housing.

Accordingly, the invention relates to an improved actuator mechanism for a height-adjustable chair arm assembly. The chair arm assembly includes a horizontal arm rest and a vertical support post which is telescopingly engaged with an upright of the chair.

The actuator mechanism includes front and intermediate levers which are contained within an arm rest housing and are connected in series to raise and lower an actuator rod of the height-adjustment mechanism. The front lever is pivotally connected to the arm rest housing and includes an actuator button that is accessible from the exterior of the arm rest to manually pivot the front lever. The front lever is engaged with an intermediate lever arm which itself is connected to the upper end of the actuator rod. Pressing of the button pivots the front lever which in turn pivots the intermediate lever to raise the actuator rod. The user then moves the arm rest upwardly to a selected position and releases the actuator button to permit the actuator rod to re-engage the locking mechanism.

While the actuator lever is pivotally connected to the arm rest by a pivot bracket, the intermediate lever includes a downwardly projecting contact or pivot surface which defines the fulcrum for the intermediate lever. The intermediate lever thereby is only laid into the compartment of the arm rest without a positive connection therebetween. Rather, the intermediate lever is maintained in the compartment by engagement of the front end thereof with the front lever and the back end thereof with the actuator rod. This arrangement is readily adaptable to a wide range of sizes and shapes for the arm rest.

In particular, since no positive connection is provided for the intermediate lever, the length and shape of the intermediate lever can readily be varied depending upon the overall length and shape of the arm rest. Further, the relative positions of the fulcrum or pivot axes on the front and intermediate levers can be adjusted to vary the vertical clearance required for operation of the actuator mechanism. In view of the foregoing, the pivot axes, lengths and shapes of the front and intermediate levers can be varied to accommodate a wide variety of shapes and sizes for the arm rest.

Other objects and purposes of the invention, and variations thereof, will be apparent upon reading the following specification and inspecting the accompanying drawings.

Figure 1:
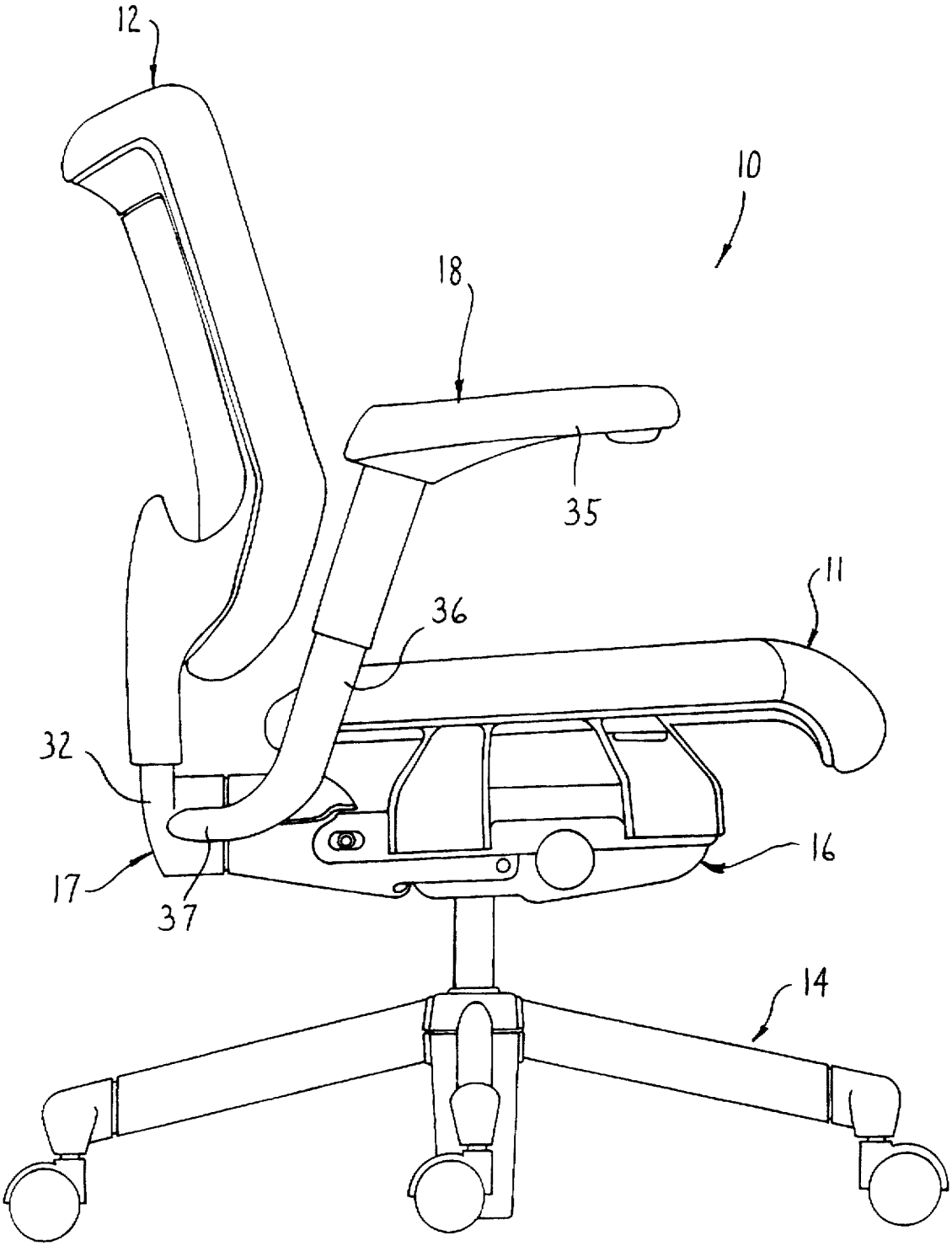
FIG. 1 is a side elevational view of the chair.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Figure 2:
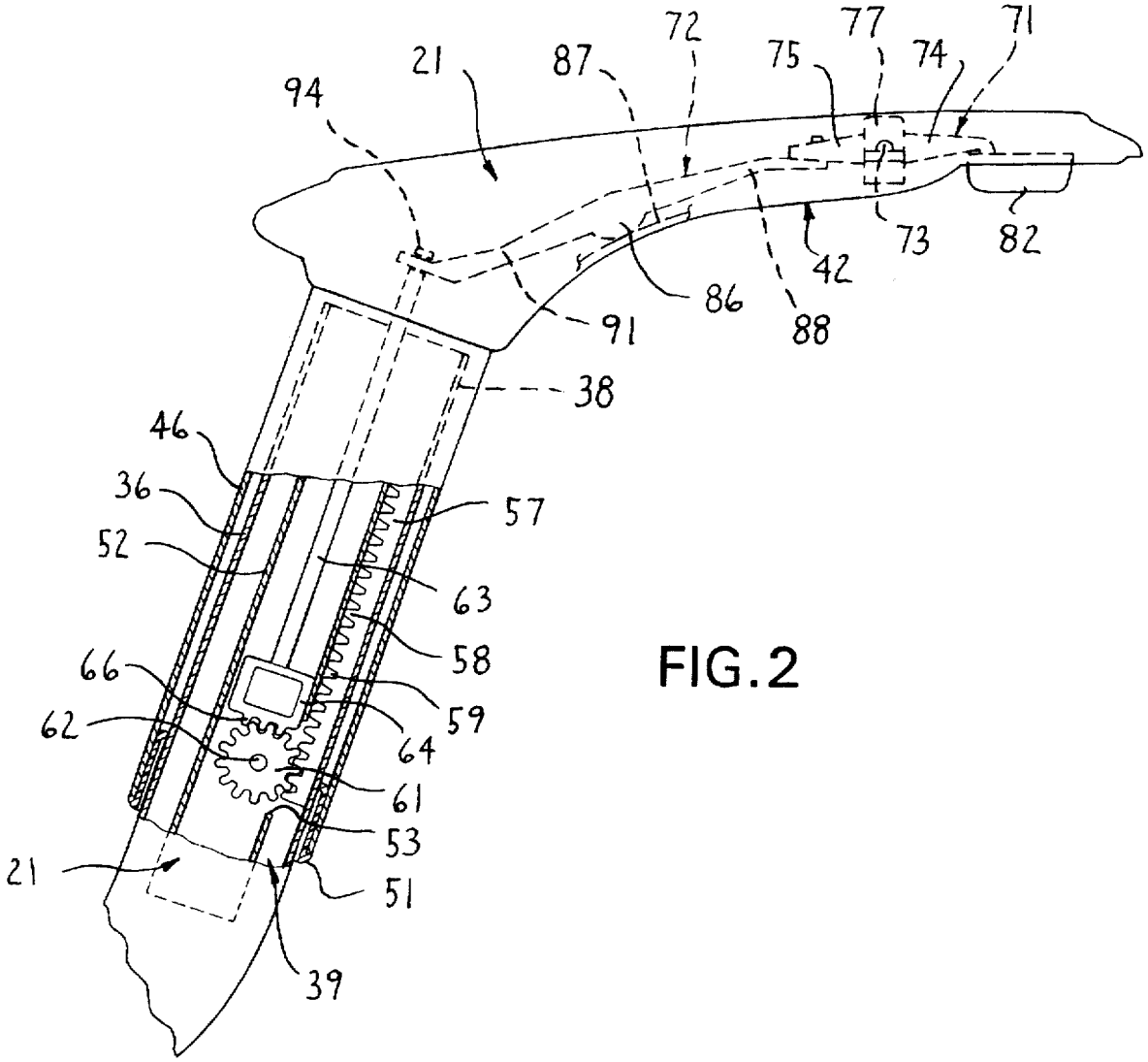
FIG. 2 is an enlarged partial side elevational view in partial cross-section illustrating a left side chair arm having a height-adjustment mechanism housed therein.

Referring to FIGS. 1–2, there is shown an office-type chair 10 which includes a seat assembly 11 and a back assembly 12 which are pivotally supported on a chair base or pedestal 14 to support a user thereon. To increase the comfort of the user, the chair 10 has height-adjustable chair arm assemblies 18 which include a height-adjustment mechanism 20 for adjusting the height of the chair arm assemblies 18, and an actuator mechanism 21 for actuating the height-adjustment mechanism 20.

Generally with respect to the main components of the chair 10, the base 14 is adapted to be supported on a floor and the seat assembly 11 is mounted to the base 14 by a tilt control mechanism 16. The tilt control mechanism 16 thereby permits rearward tilting of the seat assembly 11 relative to the base 14. The back assembly 12 is connected to the seat assembly 11 by a back torsion mechanism 17, and also supports the chair arms 18 thereon. While adjustable chair arms are known, the chair arm assemblies 18 include the inventive actuator mechanism 21 which is readily adaptable to chair arms having a wide variety of shapes and sizes as described hereinafter.

The tilt control mechanism 16 is disclosed in U.S. patent application Ser. No. 08/846,618, entitled TILT CONTROL FOR CHAIR, the back torsion mechanism 17 is disclosed in U.S. patent application Ser. No. Ser. 08/846,614, entitled CHAIR BACK WITH SIDE TORSIONAL MOVEMENT, and the seat and back assemblies 11 and 12 are disclosed in U.S. patent application Ser. No. 08/846,616, entitled MEMBRANE CHAIR. All of these applications were filed on Apr. 30, 1997. The disclosure of these applications, in their entirety, are incorporated herein by reference.

Generally, the chair arm assemblies 18 are supported on a connecting hub 32 of the back assembly 12 although they also could be supported on the seat assembly 11. Each of the chair arm assemblies 18 includes an arm rest assembly 35 spaced above the seat assembly 12 and a generally L-shaped arm upright or support member 36 which slidably supports the arm rest assembly 35 thereon.

More particularly, the lower end 37 of each arm upright 36 is rigidly connected to the connecting hub 32, for example, by welding, while the upper end 38 thereof projects upwardly therefrom to support the arm rest assembly 35. Preferably, the arm uprights 36 project outwardly toward the respective sides of the chair 10 and then forwardly. The upper ends 38 have an oval cross-section when viewed from above and are open so as to define a hollow interior 39. To facilitate the description of the chair arm assemblies 18, the left side chair arm assembly 18 is illustrated in FIGS. 2–5 although it should be understood that the right side chair arm assembly 18 is a mirror image thereof.

As described in detail hereinafter, the arm rest assembly 35 (FIGS. 2–5) includes the height-adjustment mechanism 20 mounted therein which permits vertical movement of the arm rest assembly 35 relative to the seat assembly 11. The height-adjustment mechanism 20 releasably engages the armrest 18 to the arm upright 36, and is disengaged by the actuator mechanism 21 to permit vertical movement thereof.

Generally, the arm rest assembly 35 includes an arm rest 42 which extends generally horizontally for supporting an occupant's arm thereon. The arm rest 42 is formed from a horizontally elongate arm rest housing 43 which is hollow, and an arm cap 44 which is mounted to the top of the arm rest assembly housing 43. The rearward end of the arm rest housing 43 includes a hollow support column or mounting tube 46 which projects downwardly therefrom.

To mount the arm rest assembly 35 to the arm upright 36, the support column 46 is telescopingly or slidingly engaged with the upper end 38 of the arm upright 36. The lower end of the support column 46 includes an annular bearing sleeve or collar 51 which is adapted to slide over the exterior surface of the upright 36.

The support column 46 further includes a hollow slide tube or interior post 52 therein which projects downwardly from the arm rest housing 43 and extends concentrically through the hollow interior of the support column 46. The tube 52, in the illustrated embodiment, is slidably inserted into the hollow interior 39 of the arm upright 36. The slide tube 52 includes a window or aperture 53 defined in a vertical side wall thereof, which window 53 communicates with the hollow interior 39.

The upper end of the support column 46 supports the rearward end of the arm rest housing 43 thereon so as to be vertically movable together. The arm rest housing 43 preferably extends forwardly from the support column 46 in cantilevered relation therewith and defines an upward opening hollow interior. The forward end of the arm rest housing 43 includes a button-receiving opening 56. The top of the hollow interior is enclosed by the arm cap 44 once the actuator mechanism 21 is mounted therein as described in more detail hereinafter.

Figure 3:
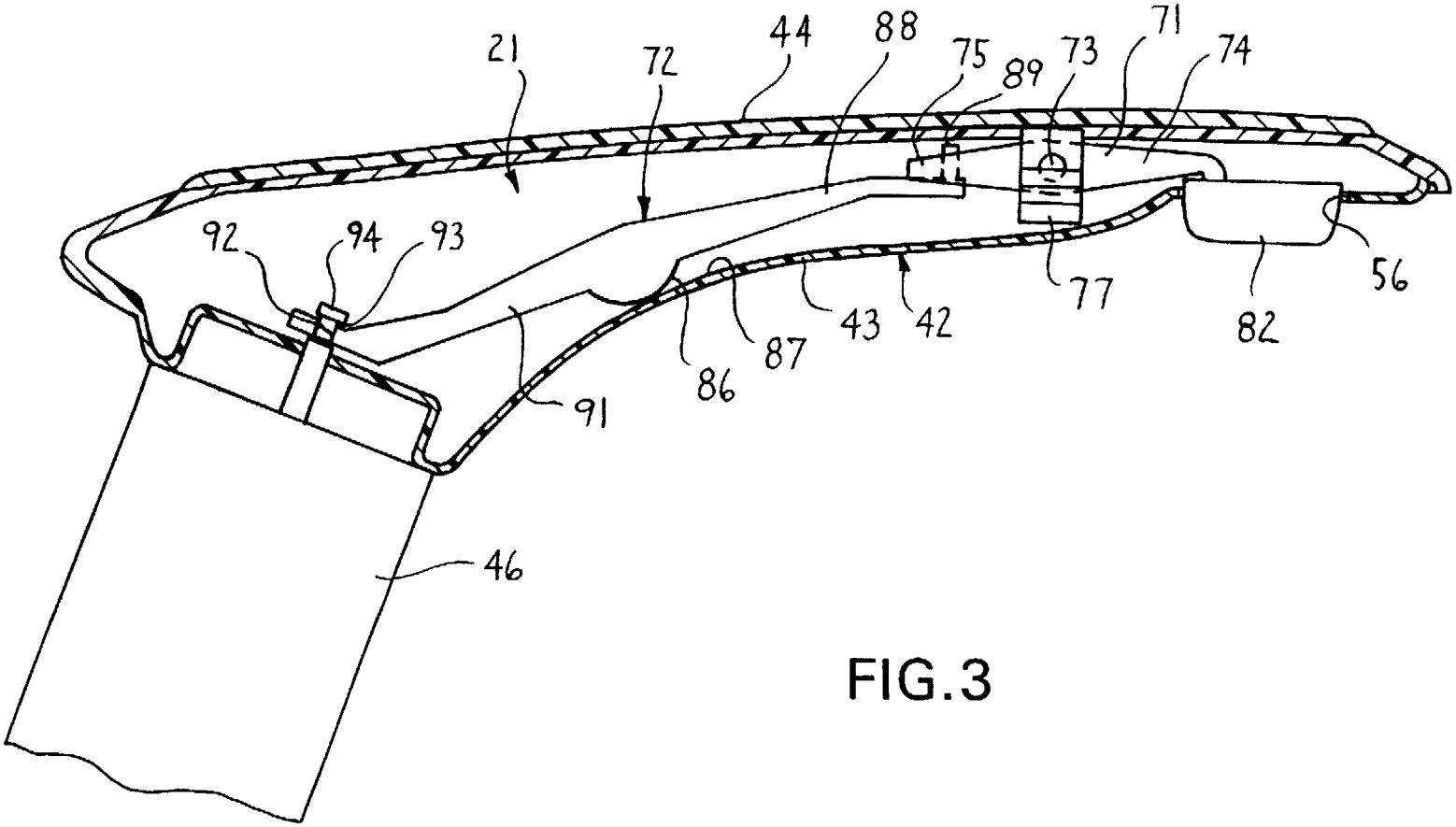
FIG. 3 is an enlarged side elevational view in partial cross section illustrating an actuator mechanism for the height-adjustment mechanism.

To effect locking of the arm rest assembly 35 at a selected height, the height-adjustment mechanism 20 is supported in the support column 46 and is engagable with the arm upright 36. More particularly, the height-adjustment mechanism 20 comprises an elongate plastic sleeve 57 (FIG. 3) which is fixed within the upper end 38 of the arm upright 36. The sleeve 57 defines a guide bore which is formed within the hollow interior 39 of the upper end 38 and extends upwardly therethrough, and further defines a gear rack 58. The gear rack 58 has a plurality of uniformly vertically spaced notches 59 which are located adjacent to the window 53 of the slide tube 52 as seen in FIG. 3.

The height-adjustment mechanism 20 further includes a gear 61 which is rotatably supported within the lower end of the slide tube 52 by a pin 62 which extends transversely between and is supported on the opposite side walls of the slide tube 52. The gear 61 is rotatably supported such that a plurality of teeth on one side of the gear 61 projects through the window 53 so as to engage the notches 59 of the gear rack 58. Thus, during vertical movement of the arm rest assembly 35 relative to the arm upright 36, the gear 61 is able to roll along the gear rack 58 in meshing engagement therewith.

The height-adjustment mechanism 20 also includes an elongate actuator rod 63 which projects upwardly through the tube 52. The upper end of the actuator rod 63 projects into the hollow arm rest housing 43, and the lower end thereof has a lock member 64 secured thereto.

The lock member 64 includes a plurality of downwardly projecting locking teeth 66 which normally engage the upper tooth portion of the gear 61 to prevent rotation thereof. The locking teeth 66 and the gear 61 thereby cooperate to provide a positive locking relationship therebetween which prevents relative movement of the arm rest support column 46 and the arm upright 36.

To permit relative vertical movement, the lock member 64 is vertically slidable in response to upward movement of the actuator rod 63 so as to be disengagable from the gear 61. When the lock member 64 is disengaged from the gear 61, the gear 61 rolls along the gear rack 58 to permit movement of the arm rest 35. However, a spring (not illustrated) acts downwardly on the lock member 64 to movably bias the locking teeth 66 back into engagement with the gear 61.

The structure and function of the height-adjustment mechanism 20 is substantially the same as the height-adjustment mechanism disclosed in U.S. patent application Ser. No. 08/731,712, entitled HEIGHT-ADJUSTABLE CHAIR ARM ASSEMBLY HAVING GEAR-TYPE ADJUSTING MECHANISM, filed on Oct. 17, 1996. The disclosure of this latter application, in its entirety, is incorporated herein by reference.

Accordingly, when the actuator rod 63 is moved upwardly, the height-adjustment mechanism 20 is disengaged, and when the actuator rod 63 moves downwardly due to the return spring (not illustrated), the height-adjustment mechanism 20 is engaged. To effect this vertical movement of the actuator rod 63, the aforementioned actuator mechanism 21 is connected to the upper end of the actuator rod 63 as described in detail hereinafter.

The actuator mechanism 21 (FIGS. 3–6) includes a button-activated front or end lever 71 which is pivotally secured to the arm rest housing 43, and an intermediate lever 72 which is connected in series between the upper end of the actuator rod 63 and the front lever 71. Pivoting of the front lever 71 about a horizontal pivot axis P1 thereby causes pivoting of the intermediate lever 72 about a horizontal pivot axis P2 to raise the actuator rod 63. Preferably, both the front lever 71 and the intermediate lever 72 are formed from a plastic or other suitable material.

More particularly, the front lever 71 includes a pair of pivot pins 73 in the center area thereof as well as front and rear lever arms 74 and 75 which project forwardly and rearwardly away from the pivot pins 73.

Figure 5:
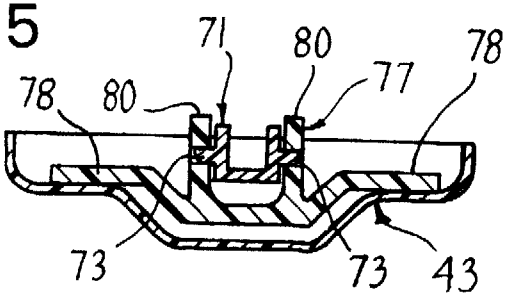
FIG. 5 is a cross-sectional view taken along line 5—5 in FIG. 4.
Figure 4:
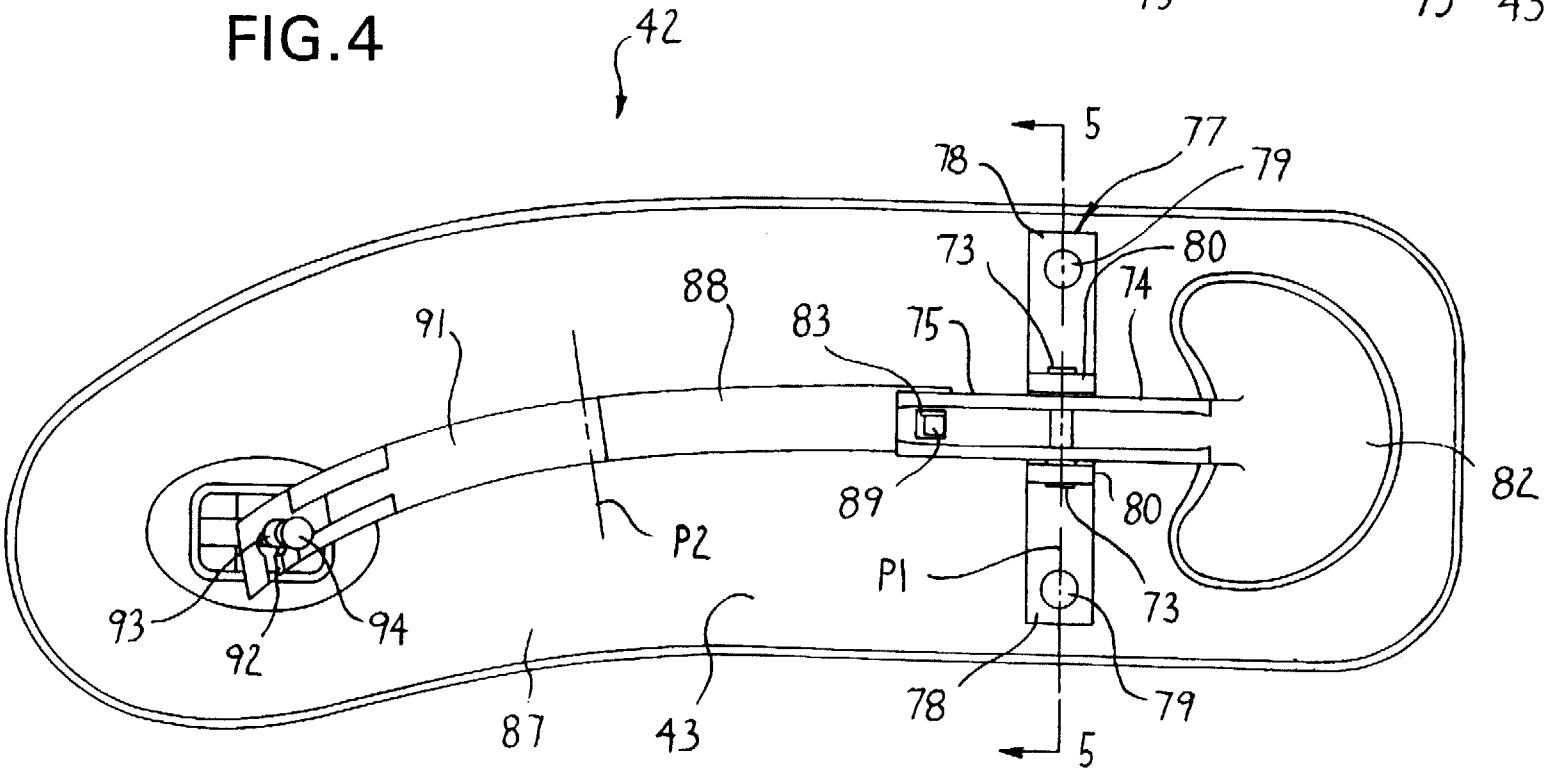
FIG. 4 is a top plan view of the chair arm of FIGS. 2 and 3.

The pivot pins 73 are rotatably supported on the arm rest housing 43 by a pivot bracket 77. As illustrated in FIGS. 4 and 5, the pivot bracket 77 includes outwardly extending flanges 78 which are fastened onto the arm rest housing 43 by appropriate fasteners 79. A pair of spaced apart bearing flanges 80 project upwardly from the flanges 78 and receive the front lever 71 therebetween. The pins 73 are pivotally connected to bores in the bearing flanges 80 such that the front lever 71 is secured in the arm rest housing 43 and pivots about the front pivot axis P1.

To actuate the front lever 71, the forward end of the front lever arm 74 is enlarged so as to define a manually actuatable button or pad 82 which projects downwardly through the opening 56 formed in the arm rest housing 43. The button 82 thereby is accessible from the exterior of the arm rest assembly 35 by an occupant.

The rear lever arm 75 projects rearwardly from the pivot pins 73 and includes a rectangular aperture 83 at the rear end thereof for the connection of the intermediate lever 72 thereto. Preferably the lengths of the front and rear lever arms 74 and 75 have a 1:1 ratio in the illustrated embodiment such that the vertical displacement of the front and rear lever arms 74 and 75 is substantially equal during pivoting.

To move the actuator rod 63, the intermediate lever 72 is interconnected between the front lever 71 and the actuator rod 63. In particular, the forward end of the intermediate lever 72 is connected to the front lever 71 while the rear end of the intermediate lever 72 is engaged with the upper end of the actuator rod 63.

To effect pivoting of the intermediate lever 72, a downwardly projecting contact or pivot surface 86 is provided in the center region thereof and is supported by an opposing interior surface 87 of the arm rest housing 43. Accordingly, the intermediate lever 72 can rock about the horizontal pivot axis P2 which is defined by the contact between the contact surface 86 and the interior surface 87. The contact surface 86 thereby defines a fulcrum for the intermediate lever 72.

To connect the intermediate lever 72 to the front lever 71, the front lever arm 88 projects forwardly away from the contact surface 86 and includes an upwardly projecting pin 89 (FIGS. 4 and 5) which extends vertically through the rectangular aperture 83 formed in the rear end of the front lever 71. The pin 89 and rectangular aperture 83 provide a positive connection between the adjacent interconnected ends of the front lever 71 and intermediate lever 72.

The intermediate lever 72 also includes a rear lever arm 91 which projects rearwardly away from the contact surface 86 and includes a sidewardly opening slot or aperture 92 which generally has a keyhole shape. The slot 92 is connected to a reduced-width groove 93 formed about a pin section 94 at the upper end of the actuator rod 63. The actuator rod 63 is slid sidewardly into the slot 92 so as to provide a positive connection therebetween wherein the actuator rod 63 is pulled upwardly by the intermediate lever 72 although the actuator rod 63 also could be pushed upwardly by the intermediate lever 72 if it was located above the rear lever arm 91. Preferably, the lengths of the front and rear lever arms 88 and 91 of the intermediate lever 72 have a 1:1 ratio.

Further, the illustrated embodiment of the arm rest assembly 35 has a non-linear shape which curves sidewardly along the longitudinal length thereof. In particular, the intermediate lever 72 has an arcuate or curved shape when viewed from above such that the connection of the intermediate lever 72 to the actuator rod 63 is offset sidewardly from the connection of the front end of the intermediate lever 72 with the front lever 71. The skilled artisan will also appreciate that the intermediate lever 72 can be formed so as to have other non-linear shapes. Accordingly, the rear pivot axis P2 is skewed relative to the front pivot axis P1.

Also, the intermediate lever 72 angles downwardly toward the actuator rod 63 when viewed from the side. In particular, the front lever arm 88 is oriented at an acute angle relative to the rear lever arm 91 of the intermediate lever 72. This angle can be varied depending upon the side profile of the arm rest housing 43.

With this arrangement, upward movement of the button 82 pivots the front lever 71 and effects a corresponding pivoting movement of the intermediate lever 72. The rear lever arm 91 of the intermediate lever 72 thereby pivots about the pivot axis P2 so as to raise the actuator rod 63 upwardly and effect disengagement of the height-adjustment mechanism 20 as described above.

The actuator rod 63 thereby is pulled upwardly against the bias of the spring (not illustrated) so as to disengage the locking teeth 66 from the gear 61, thus allowing the gear 61 to roll along the gear rack 58 and permit height adjustment of the arm rest assembly 35. When the occupant desires to lock the arm rest assembly 35 at a selected height, the button 82 is released and the spring (not illustrated) urges the locking teeth 66 downwardly so as to automatically re-engage the lock member 64 with the gear 61.

As can be seen, the actuator mechanism 21 readily provides for engagement and disengagement of the height-adjustment mechanism 20. This actuator mechanism 21 also is readily adaptable for use in other arm rest configurations.

In particular, the actuator mechanism 21 can be readily adapted to various configurations of the arm rest assembly 35 particularly by varying the overall length, fulcrum position, side profile and top profile of the levers 71 and 72.

For example, the relative ratios of the lever arms of each of the front and intermediate levers 71 and 72 can be varied. While a 1:1 ratio is provided for the arms of both the front lever 71 and intermediate lever 72, these ratios can be varied to vary the vertical space required for the movement of the levers 71 and 72 which space depends upon the vertical space or clearance provided within a particular arm rest housing.

With respect to the front lever 71, the length of the rear lever arm 75 of the front lever 71 can be increased to increase the vertical travel of this arm in response to the same amount of vertical travel of the button 82. This thereby increases the vertical travel provided at the rear end of the intermediate lever 72. Conversely, the length of the rear lever arm 75 relative to the front lever arm 74 of the front lever 71 can be reduced so as to reduce the overall amount of vertical travel thereof. The intermediate lever 72 also can be varied in a similar manner to provide significant flexibility in accommodating the different space requirements of an arm rest.

Still further, the intermediate lever 72 provides additional flexibility in constructing the arm rest assembly 35. Since the intermediate lever 72 is not fixedly connected to the arm rest housing 43 but only is provided in abutting engagement therewith, the intermediate lever 72 is readily removable and an alternative size or configuration of the intermediate lever 72 can be provided without requiring a change in the design or construction of the front lever 71 or the mounting bracket 77. For example, if a shorter arm rest assembly 35 is desired, the same front lever 71 and mounting bracket 77 can be provided while a different sized intermediate lever is used to accommodate the differences in dimensions of the alternative arm rest.

Still further, the intermediate lever 72 also can be provided with any desired shape such as the shape illustrated in FIG. 5 which is non-linear when viewed from the side and the top thereof. This curved intermediate lever 72 can then be used in arm rests 42 which have curved or non-linear configurations.

Additional levers may also be connected in series between the levers 71 and 72. The additional levers can be used to extend the distance between the actuator button 82 to the actuator rod 63, or an odd number of levers may be provided to push the actuator rod 63 in a direction which is opposite to the movement of the button 82. As can be seen, the height-actuator mechanism 21 can be readily adapted to a wide variety of arm rest constructions which can vary in size and shape.

Although a particular preferred embodiments of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A chair arm assembly for a chair comprising:

a vertically elongate arm upright which is adapted to be mounted to a seat assembly of a chair;

an arm rest assembly having a support member movably supported by said arm upright and a horizontally elongate arm rest which has a hollow interior and extends generally horizontally away from said support member;

a height-adjustment mechanism co-acting between said arm upright and said support member for adjusting the height of said arm rest assembly relative to said arm upright, said height-adjustment mechanism including disengagement means comprising an actuator member which extends into said arm rest and is movable in a first direction for disengaging said height-adjustment mechanism to permit movement of said arm rest assembly to a selected height; and an actuator mechanism disposed within said arm rest which includes a plurality of levers that are pivotable respectively about a corresponding plurality of pivot axes, each of said levers having pivot means for pivotally connecting said lever to said arm rest such that said lever pivots about a corresponding one of said pivot axes, said plurality of levers comprising a first lever which has a manually actuatable end part that is accessible from an exterior of said arm rest to effect pivoting thereof, and a second lever having one end thereof connected to said actuator member, said plurality of levers being connected together in series such that pivoting of said first lever about said pivot axis corresponding thereto effects pivoting of said second lever about said pivot axis corresponding thereto to move said actuator member in said first direction, whereby said height-adjustment mechanism is disengaged.

2. A chair arm assembly according to claim 1, wherein said second lever extends generally horizontally and includes lever arms at the opposite ends thereof which move generally vertically during pivoting of said plurality of levers about said pivot axes corresponding thereto.

3. A chair arm assembly according to claim 1, wherein said arm rest includes a passage between said hollow interior and said exterior, said manually actuatable end part of said first lever projecting through said passage to said exterior.

4. A chair arm assembly according to claim 3, wherein said arm rest comprises a hollow arm rest housing and a top cap enclosing said housing, said actuator mechanism being contained within said arm rest housing, said pivot means of said first lever being securely engaged to a bearing part of said arm rest housing for pivotally supporting said first lever in said arm rest.

5. A chair arm assembly according to claim 1, wherein each one of said plurality of levers extends longitudinally along said arm rest in end-to-end relation, adjacent ends of each adjacent pair of said plurality of levers being connected together.

6. A chair arm assembly according to claim 5, wherein the opposite ends of each of said plurality of levers move in said first direction or a second direction opposite said first direction during pivoting of said first and second levers.

7. A chair arm assembly according to claim 5, wherein said manually actuatable end part is at one end of said first lever and said first lever has a first end opposite said manually actuatable end part, said respective pivot axis of said first lever being defined between said first end and said manually actuatable end part, said second lever having a second end opposite said one end thereof, said respective pivot axis of said second lever being defined between said second end and said one end, said first and second ends being interconnected together such that said second lever pivots in response to pivoting of said first lever.

8. In a chair having a seat assembly and a pair of height-adjustable chair arm assemblies disposed adjacent opposite sides of said seat assembly, the improvement wherein each of said chair arm assemblies comprises:

a vertically elongate arm upright which is fixed relative to said seat assembly;

an arm rest assembly having a vertically elongate support member lengthwise movably supported by said arm upright and a horizontally elongate arm rest mounted on an upper end of said support member, said arm rest projecting generally horizontally away from said support member in a longitudinal direction;

a releasable height-adjustment mechanism co-acting between said arm upright and said support member for fixedly positioning said support member relative to said arm upright at any one of a plurality of selectable height positions, said height-adjustment mechanism including disengagement means comprising an actuator member which is movable vertically in a first direction for disengaging said height-adjustment mechanism to permit movement of said arm rest assembly; and an actuator mechanism disposed within said arm rest which includes a plurality of levers which are pivotally connected to said arm rest, said plurality of levers being serially connected together in end-to-end relation and including first and second levers pivotally connected to said arm rest so as to pivot about respective first and second pivot axes, said first lever having opposite first and second ends connected respectively to said actuator member and an adjacent end of said second lever such that pivoting of said second lever about said second pivot axis effects pivoting of said first lever about said first pivot axis to move said actuator member in said first direction, said first lever being horizontally elongate and having a pivot part which abuts against an opposing surface of said arm rest to define said first pivot axis, said first lever being supported in said arm rest solely by the connection of said first and second ends to said actuator member and said second lever.

9. A chair according to claim 8, wherein first engagement means and second engagement means connect said respective first and second ends of said first lever to said actuator member and said second lever, said first engagement means comprising a first aperture in one of said first lever and said actuator member and a first pin in the other of said first lever and said actuator member, said first pin projecting through said first aperture, said second engagement means comprising a second aperture formed in an end section of one of said first and second levers and a second pin formed in an end section of the other of said first and second levers, said second pin projecting through said second aperture.

10. A chair according to claim 8, wherein said first and second levers are pivotable about said respective first and second pivot axes which are oriented transverse to a longitudinal axis of said arm rest, said second pivot axis being skewed relative to said first pivot axis.

11. A chair according to claim 8, wherein first and second engagement means connect said respective first and second ends of said first lever to said actuator member and said second lever, said first lever having a non-linear shape when viewed from above such that said second engagement means is offset sidewardly relative to said first engagement means.

12. A chair according to claim 8, wherein each of said plurality of levers includes opposite ends and pivot means disposed between said opposite ends for defining a respective pivot axis, said opposite ends being displaceable in opposite directions about said respective pivot axis during said pivoting of said plurality of levers, the amount of displacement of said opposite ends to each other being determined by the position of said respective pivot axis therebetween.

13. A chair according to claim 12, wherein said first lever includes first pivot means which defines said first pivot axis for pivotally connecting said first lever to said arm rest, said first pivot means including a bracket fastened to said arm rest which non-removably supports said first lever thereon.

14. In a chair having a seat assembly and a pair of height-adjustable chair arm assemblies disposed adjacent opposite sides of said seat assembly, the improvement wherein each of said chair arm assemblies comprises:

a vertically elongate arm upright which is fixed relative to said seat assembly;

an arm rest assembly having a vertically elongate support member lengthwise movably supported by said arm upright and a horizontally elongate arm rest mounted on an upper end of said support member, said arm rest projecting generally horizontally away from said support member in a longitudinal direction;

a releasable height-adjustment mechanism co-acting between said arm upright and said support member for permitting said support member to be fixedly positioned relative thereto at any one of a plurality of selectable height positions, a lock mechanism including disengagement means comprising a vertically movable actuator member for disengaging said height-adjustment mechanism to permit movement of said arm rest assembly; and an actuator mechanism connected to said actuator member for disengaging said height-adjustment mechanism, said actuator mechanism comprising a manually actuatable end lever and an intermediate lever connected between said actuator member and said end lever, said end lever including first pivot means disposed between first and second lever arms for pivotally connecting said end lever to said arm rest, said first lever being actuatable from an exterior of said arm rest, said intermediate lever including second pivot means disposed between third and fourth lever arms for pivotally connecting said intermediate lever to said arm rest, said fourth lever arm being connected to said actuator member and said third lever arm being engaged with said second lever arm such that said intermediate lever pivots in response to pivoting of said end lever to thereby effect generally vertical movement of said actuator member.

15. A chair according to claim 14, wherein said intermediate lever has a non-linear shape which curves away from a longitudinal axis of said arm rest such that the connection of said fourth lever arm to said actuator member is offset relative to the connection between said third lever arm and said second lever arm.

16. A chair according to claim 14, wherein the length of said first lever arm relative to the length of said second lever arm, and the length of said third lever arm relative to the length of said fourth lever arm have a ratio of 1:1.

17. A chair according to claim 14, wherein said first pivot means comprises pivot pins projecting outwardly from said end lever which are fixedly pivotally engaged with bearing parts on said arm rest, said pivot pins defining a first horizontal pivot axis which is oriented transverse to a longitudinal axis of said arm rest.

18. A chair according to claim 17, wherein said second pivot means comprise a downwardly projecting curved pivot part which abuts against an opposing interior surface of said arm rest, said pivot part defining a second pivot axis oriented transverse to said longitudinal axis.

19. A chair according to claim 14, wherein said intermediate lever includes a downwardly projecting contact surface which is disposed in abutting contact with an opposing surface of said arm rest so as to define a second pivot axis, said intermediate lever being secured in said arm rest solely by the connection between said second and third lever arms and the connection between said fourth lever arm and said actuator member.

20. A chair according to claim 19, wherein said connection between said second and third lever arms comprises a pin projecting from one of said second and third lever arms and an aperture formed in the other of said second and third lever arms, said pin projecting through said aperture to prevent sideward movement of said third lever arm relative to said second lever arm.

* * * * *